United States Patent [19]

Takasaki

[11] Patent Number: 4,551,579

[45] Date of Patent: Nov. 5, 1985

[54] CONSTRUCTION OF A CONNECTION FOR FLAT CABLES

[75] Inventor: Shuichi Takasaki, Moriguchi, Japan

[73] Assignee: Matsushita Electric Works, Ltd., Osaka, Japan

[21] Appl. No.: 536,729

[22] Filed: Sep. 28, 1983

[30] Foreign Application Priority Data

Oct. 8, 1982 [JP] Japan ..... 57-153433[U]

[51] Int. Cl.[4] ..... H01R 9/07; H01R 4/18

[52] U.S. Cl. ..... 174/88 R; 174/84 C; 174/117 FF; 339/97 C

[58] Field of Search ..... 174/88 R, 84 C, 117 F, 174/117 FF; 339/97 C

[56] References Cited

U.S. PATENT DOCUMENTS

| | | | |
|---|---|---|---|
| 3,753,213 | 8/1973 | Frey | 174/88 R X |
| 3,902,004 | 8/1975 | Harding et al. | 174/84 C |
| 3,960,430 | 6/1976 | Bunnell et al. | 174/88 R X |
| 4,255,612 | 3/1981 | Grundfest | 174/117 FF X |
| 4,315,662 | 2/1982 | Greenwood et al. | 174/88 R |
| 4,348,548 | 9/1982 | Grundfest | 174/88 R |

FOREIGN PATENT DOCUMENTS 1590664 5/1970 Fed. Rep. of Germany .

*Primary Examiner*—A. T. Grimley
*Assistant Examiner*—Morris H. Nimmo
*Attorney, Agent, or Firm*—Stevens, Davis Miller & Mosher

[57] ABSTRACT

A flat electrical cable for use under a rug or carpet having a series of regularly spaced elongate apertures in a web of insulating material along one edge of the cable. "U" shaped conductive connectors are used to secure adjacent cables together with an upper segment of the connector passing through an aperture of each cable so as to properly position the cables in respect to each other and electrically connect the cable conductors by means of sharpened pawls on the connector which pierce the plastics insulation of each cable.

3 Claims, 8 Drawing Figures

Fig. 1 *(PRIOR ART)*
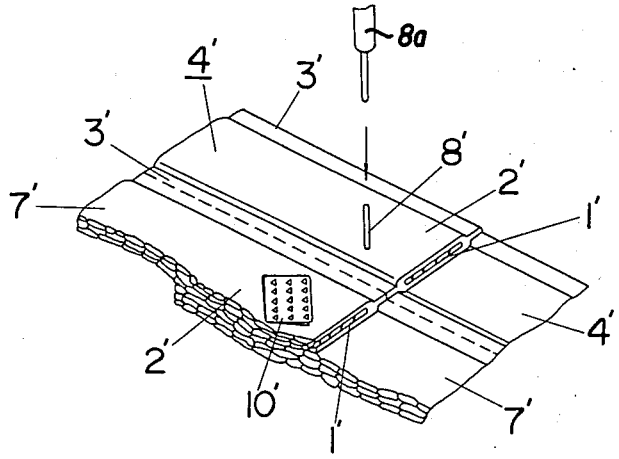
Fig. 2 *(PRIOR ART)*
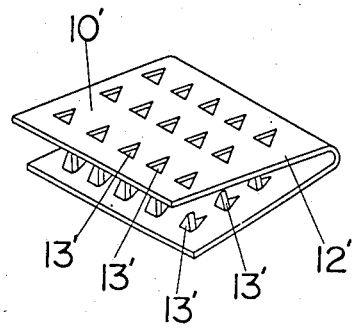
Fig. 3
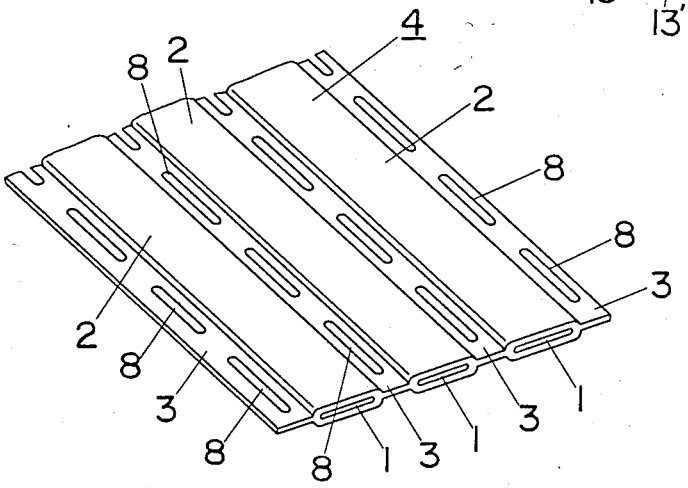

CONSTRUCTION OF A CONNECTION FOR FLAT CABLES

BACKGROUND AND BRIEF DESCRIPTION OF THE INVENTION

This device relates to a construction of a connection for flat cables placed under a carpet, and more particularly to means for avoiding heat generation at the juncture of the connection and the cable.

Conventionally, a flat cable 5', is disposed on a lower surface protective sheet of a flat-shaped cable 4' having lengthwise thereof conductor enclosing portions 2' enclosing therein conductors 1' and insulating portions or webs 3' enclosing no conductor and covering the cable 4' by a protective sheet. In the prior art, this cable is connected electrically to the adjacent flat cables 7', 7' in such a manner that the conductor enclosing portions 2' at the end portion of flat cables 7', as shown in FIG. 1, are pierced with through-bores 8' by means of a tool 8*a* used on the job. Conductive connectors 12' are inserted into the through-bores. Each conductive connector 10' on the conductor enclosing portion 2' establishes a connection with one flat cable 7' by means of pawls 13' on a lower segment 11' on the conductor enclosing portion 2'. The other flat cable 7' is thereby electrically connected to the conductors 1', 1' of the adjacent flat cables 7', 7'. In such a conventional example, however, piercing the through bores 8' through the conductors 1' greatly reduces the cross-sectional area thereof at the portion corresponding to the through bore 8', thereby involving the problem that heat is generated when the cable is energized. Furthermore, boring for the through 8' is done in the field. The boring should be carefully positioned at the center of conductor 1', but this is difficult to do on the job. Also, in case that through bores 8', 8' at the upper and lower cables 4', 4' shift relative to each other, there is a problem in obtaining proper alignment.

In light of the above problems, this device has been designed. An object thereof is to provide a construction of a connection for the flat cables, which can eliminate the field work for boring and positioning the adjacent cables, thus avoiding electrical problems.

BRIEF DESCRIPTION OF THE DRAWINGS

FIG. 1 is a perspective view of an example of a prior art connection of overlapping flat cables;

FIG. 2 is a perspective view of a prior art conductive connection;

FIG. 3 is a perspective view of the apertured flat cable of the present invention;

FIG. 4(*b*) is a top view of one of the apertures;

Figure 4:
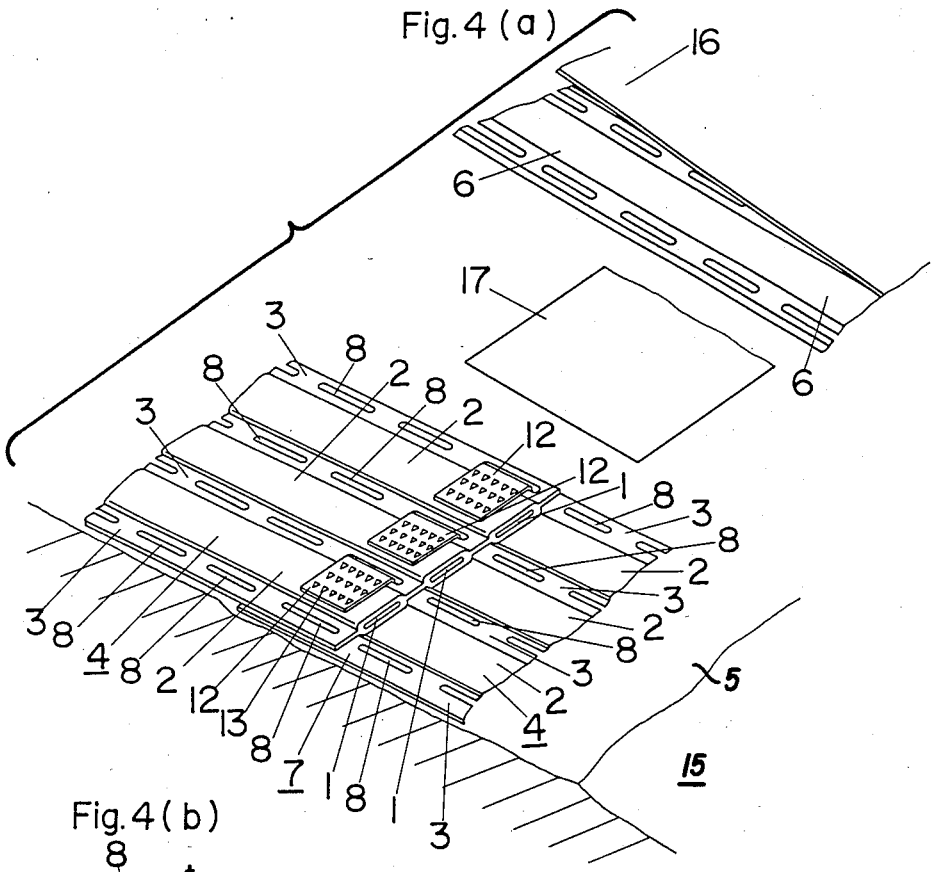
FIG. 4(*a*) is a perspective exploded view of two apertured flat cables of the present invention lying in overlapping relationship and secured together by a conductive connector of this invention.
Figure 4:
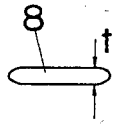

This device relates to a construction of a connection for flat cables, which is designed to have a flat cable 7 which has a protective sheet 5 disposed on a lower surface and a sheetlike-shaped cable 4 having a conductor enclosing portion 2 into which a conductor 1 is enclosed and an insulating or web portion 3 enclosing no conductor and covering the cable 4 with a protective sheet 6. In such a cable, a bore 8 is bored in the insulating portion 3 of the cable 4, the adjacent cables 4, 4 are positioned adjacent to each other, a conductive connector 12 having an upper segment 10 and a lower segment 11 joined by a bent portion 9 is inserted through the bore 8 so that the upper segment 10 and lower segment 11 sandwich the ends of adjacent cables 4, 4 from above and below. The sharpened pawls 13 on the upper and lower segments 10 and 11 (see FIG. 2) pierce the plastics material on the conductors 1 of the adjacent cables 4, 4, thereby electrically connecting the cables 4, 4.

Next, an embodiment of the device will be detailed in accordance with the drawings.

Figure 5:
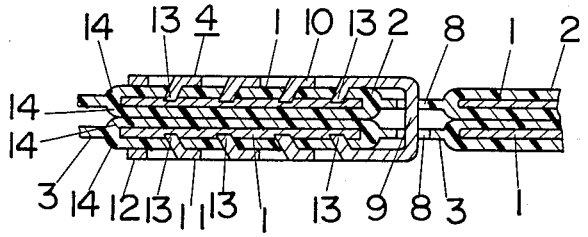
FIG. 5 is a sectional through one of the conductors of FIG. 4(*a*)

In FIG. 5, numeral 4 is a flat cable adjacent a similar flat cable and comprises a plurality of conductors 1 covered by a plastics insulating material 14. In the embodiment of FIG. 3, three conductors 1 are provided, the central conductor 1 is a grounded wire, both outside conductors being live wires. Insulating portions 3 enclosing no conductor of the cable 4, as shown in FIG. 3, are provided with elongate through bores or apertures 8 disposed lengthwise of insulating portion 3 at about regular intervals. 12 designates conductive connectors, each having an upper segment 10 and a lower segment 11 connected through a bent portion 9, the upper and lower segments 10 and 11 having pawls 13 each raised at the tip.

In FIG 4*a*, the flat cable 7 is laid on the floor in such a manner that on the floor 15 is placed an insulating lower surface protective sheet 5, such as a synthetic resin sheet, upon which the cable 4 is laid, a conductive protective sheet, such as brass, is layered over the cable 4, and a carpet 16 is placed on the protective sheet 6. In a case where the upper protective sheet 6 is formed of conductive material, such as brass, the protective sheet 6 is electrically connected to the central conductor 1, serving as the grounding wire, which is in turn connected to a grounding source. Hence, even when a tack or a pin perforates the carpet 16 and contacts with the conductor 1 of the live wire, it is grounded through the protective sheet 6 and conductor 1 of the grounding wire.

The cables 4, 4, as shown in FIG. 4(*a*) are overlapped with each other at their ends, the bores 8 are aligned in position, the lower segment 11 of conductive connector 12 is inserted into the bore 8, and the pawls 13 on the upper and lower segments 10 and 11 are forced to pierce the conductor enclosing portion 2 and connected electrically with the conductors 1, so that the cables 4, 4 are electrically connected with each other. Since each conductive connector 12 is inserted into each bore 8 and mounted to the cable 4, there is no fear of short-circuiting the conductive conductors 12, 12 which might carelessly come in contact with each other. Furthermore, the bores 8, 8 are aligned with each other to enable positioning of cables adjacent each other, thereby facilitating cable placement. Also, a width t of bore 8 is made equal to the thickness of bent portion 9 and the bores 8, 8, as shown in FIG. 4(*b*), are round at both ends to avoid stress concentration.

After the cables 4, 4 are connected as abovementioned, an insulating sheet 17 is layered on the conductive conductors 12 and the protective sheet 6 is layered thereon.

Figure 6:
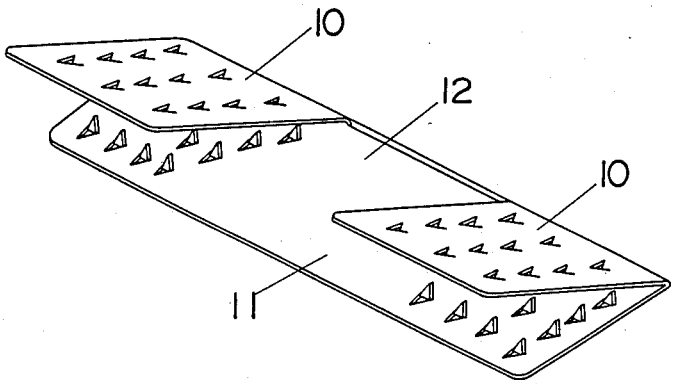
FIG. 6 is a perspective view, similar to FIG. 2, of a modified embodiment of the conductive connector of the invention.
Figure 7:
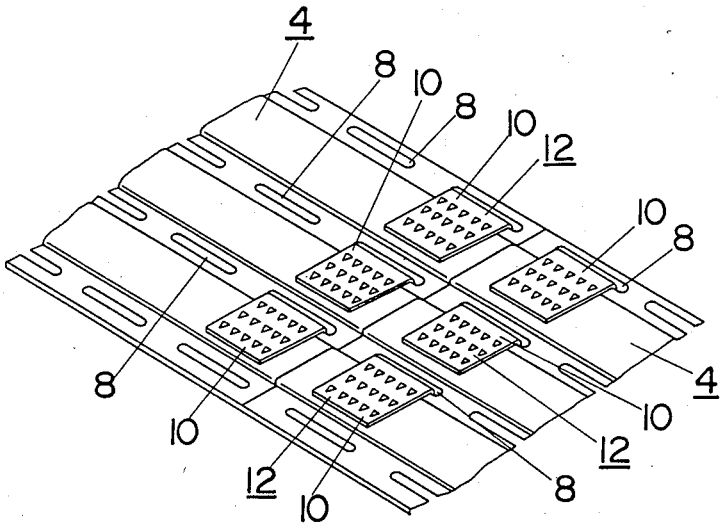
FIG. 7 is a perspective view of two apertured flat cables in end-to-end relationship secured by the conductive connector of FIG. 6.

FIGS. 6 and 7 show a modified embodiment of the invention, in which adjacent cables 4, 4 abut against each other in end-to-end relationship and a conductive connector 12, as shown in FIG. 6, is inserted with its upper segments 10, 10 into the bores 8, 8 respectively, and subsequently squeezed together, thereby electrically connecting the cables 4 as abovementioned.

In addition, the bores or apertures 8, which are provided in the adjacent web 3 in the same spacing, may properly be shifted in relation to each other. Each conductor 1 is flatbelt-like-shaped.

As seen from the above, the device, which has existing apertures in insulating portion or webs 3, avoids the field work of boring. Also, the conductive connector having the upper and lower segments (joined by the bent portion 9) is inserted through a bore so that the upper and lower segments sandwich the ends of adjacent flat cables from above and below and the pawls provided on the upper and lower segments pierce the insulating plastics on the conductors of the adjacent flat cables, thereby electrically connecting them. Hence, the device is advantageous in that the conductors are not reduced in their cross-sectional area because of a bore therethrough, no heat is generated in the conductor, and electrical problems are avoided. Furthermore, there is the advantage that the bores for insertion of conductive connector are bored with accuracy to enable positioning of the adjacent flat cables which are to be connected, thereby creating no relative shift in position of flat cables at their connection.

What is claimed is:

1. A connection of two electrically conductive flat cables and a connector therefor, each cable having an outer sheath of insulating material with at least one elongated flat electrical conductor embedded in said insulating material and a web portion, containing no conductor, extending along at least one elongate edge of the cable, said connection comprising:

a series of elongated apertures through said web portion at spaced intervals along the length thereof;

said connector being of an electrically conductive flat material bent into a generally "U" shape having two upper segments and a lower segment connected to said upper segments by bending portions;

a plurality of upstanding sharpened pawls projecting from the inner surface of at least one of said upper or lower segments;

the two upper segments being spaced apart a distance equal to the distance between two of said elongated apertures, the two upper segments passing through two of said elongated apertures and the upper and lower segments mechanically bent toward each other along the bending portions sandwiching therebetween end portions of the two adjacent flat cables with the sharpened pawls piercing said insulating material and contacting the embedded electrical conductors of both said cables and establishing an electrical connection between the conductors.

2. The connection of claim 1 in which the two adjacent flat cables are positioned end-to-end and held by said connector.

3. The connection of claim 1 in which the flat cables are multiconductor cables, each conductor having an adjacent web with said series of elongated apertures.

* * * * *